US008399752B2

(12) United States Patent
Plotnizky

(10) Patent No.: US 8,399,752 B2
(45) Date of Patent: Mar. 19, 2013

(54) MUSICAL INSTRUMENT FOR THE HANDICAPPED

(75) Inventor: Nachman Plotnizky, Kiryat-Ono (IL)

(73) Assignee: Milbat—Giving Quality to Life, Ramat-Gan (IL)

( * ) Notice: Subject to any disclaimer, the term of this patent is extended or adjusted under 35 U.S.C. 154(b) by 179 days.

(21) Appl. No.: 12/391,278

(22) Filed: Feb. 24, 2009

(65) Prior Publication Data

US 2010/0212473 A1 Aug. 26, 2010

(51) Int. Cl.
*G10F 1/12* (2006.01)

(52) U.S. Cl. ..... 84/90

(58) Field of Classification Search ..... 84/90
See application file for complete search history.

(56) References Cited

U.S. PATENT DOCUMENTS

| | | | | |
|---|---|---|---|---|
| 3,111,056 | A * | 11/1963 | Weigl | 84/425 |
| 5,174,224 | A * | 12/1992 | Nagy et al. | 108/185 |
| 5,544,562 | A * | 8/1996 | Jeon | 84/470 R |
| 6,092,868 | A * | 7/2000 | Wynn | 297/217.3 |
| 7,674,971 | B2 * | 3/2010 | Saunders | 84/744 |
| 2005/0121565 | A1 * | 6/2005 | Johnson | 248/125.1 |
| 2007/0211071 | A1 * | 9/2007 | Slotznick et al. | 345/594 |

OTHER PUBLICATIONS

Official Action Dated Nov. 8, 2011 From the US Patent and Trademark Office Re. U.S. Appl. No. 12/391,278.

* cited by examiner

*Primary Examiner* — Jianchun Qin

(57) ABSTRACT

A system and method for music playing and enjoyment, especially by handicapped persons. In some implementations, the system includes automatic height adjustment. In some implementations, the system includes oversized keys suitable for activation not body parts other than fingers. The sound quality is desirably professional.

10 Claims, 3 Drawing Sheets

MUSICAL INSTRUMENT FOR THE HANDICAPPED

FIELD AND BACKGROUND OF THE INVENTION

The present invention, in some embodiments thereof, relates to a musical instrument and, more particularly, but not exclusively, to an organ-like device suitable for handicapped persons.

Various organs have been designed for use by children and by adults. However, to date, handicapped users find difficulty in utilizing such organs for fun, education and/or musical training.

SUMMARY OF THE INVENTION

The present invention, in some embodiments thereof, relates to an electric organ system suitable for handicapped people, for example, people in wheelchairs and people with motor, cognitive (including Alzheimer's disease), perceptual, visual and/or hearing impairments.

In an exemplary embodiment of the invention, the organ system is configured to provide high quality sound (and/or octave range (e.g., 2, 3, 4, 5 octaves) and/or sound options) and not low quality as in children's toys.

There is provided in accordance with an exemplary embodiment of the invention a musical instrument adapted for the use of handicapped persons, comprising:

(a) a keyboard comprising a plurality of keys and at least one audio signal generating circuitry which generates a music-quality audio signal in response to key pressing;

(b) an electrically controlled stand on which said keyboard is mounted, suitable for raising said keyboard to at least a height of 40 cm; and (c) at least one user input which controls a height of said stand.

Optionally, said input is mounted on said keyboard. Optionally or alternatively, said input comprises a smart card reader.

In an exemplary embodiment of the invention, each of said keys is at least 3 cm wide.

In an exemplary embodiment of the invention, each of said keys is color- and number-coded in a human-visual manner and in a tactile manner.

In an exemplary embodiment of the invention, the instrument includes a connection to a computer.

In an exemplary embodiment of the invention, the instrument includes a display which shows keys being played or to be played.

There is provided in accordance with an exemplary embodiment of the invention an electric organ, comprising:

(a) at least 8 keys arranged in a row, each key being at least 3 cm wide;

(b) audio circuitry configured to convert key-presses on said keys into musical notes of a musical quality over a range of one octave or more.

Optionally, at said keys are at least 40 cm wide in total. Optionally or alternatively, said keys are adapted for being used by hitting with a fist.

There is provided in accordance with an exemplary embodiment of the invention an electric organ retrofit, comprising:

(a) a casing sized to fit over an electric organ; and (b) a plurality of at least 8 keys mounted on said casing, each of said keys activate sat least one key of said organ. Optionally, said plurality of keys are each wider than 3 cm.

There is provided in accordance with an exemplary embodiment of the invention a method of retrofitting an organ, comprising:

(a) providing a casing with keys over the organ; and (b) linking each of said keys to at least one key of said organ.

There is provided in accordance with an exemplary embodiment of the invention a music system, comprising:

(a) a stand having an organ with oversized keys of at least 3 cm in width mounted thereon at a first height;

(b) a wheelchair having a lap height matching said first height.

There is provided in accordance with an exemplary embodiment of the invention a method of engaging handicapped people, comprising:

providing an handicapped-adjusted organ; and causing a handicapped person to play a plurality of musical quality notes on said organ. Optionally, said person is cognitively handicapped. Optionally or alternatively, said person is motoricly handicapped. Optionally or alternatively, causing to play comprises causing to hit with a clenched fist.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

Implementation of the method and/or system of embodiments of the invention can involve performing or completing selected tasks manually, automatically, or a combination thereof. Moreover, according to actual instrumentation and equipment of embodiments of the method and/or system of the invention, several selected tasks could be implemented by hardware, by software or by firmware or by a combination thereof using an operating system.

For example, hardware for performing selected tasks according to embodiments of the invention could be implemented as a chip or a circuit. As software, selected tasks according to embodiments of the invention could be implemented as a plurality of software instructions being executed by a computer using any suitable operating system. In an exemplary embodiment of the invention, one or more tasks according to exemplary embodiments of method and/or system as described herein are performed by a data processor, such as a computing platform for executing a plurality of instructions. Optionally, the data processor includes a volatile memory for storing instructions and/or data and/or a non-volatile storage, for example, a magnetic hard-disk and/or removable media, for storing instructions and/or data. Optionally, a network connection is provided as well. A display and/or a user input device such as a keyboard or mouse are optionally provided as well.

BRIEF DESCRIPTION OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

DESCRIPTION OF EMBODIMENTS OF THE INVENTION

Figure 1:
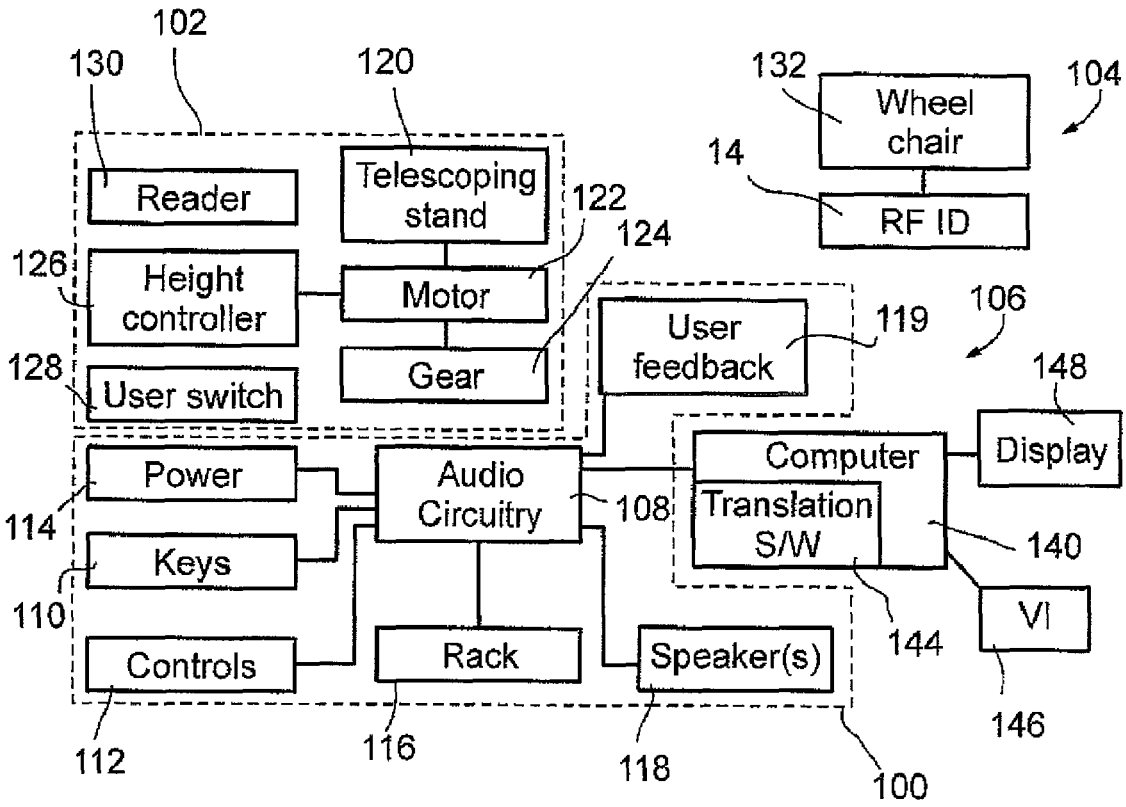
FIG. 1 is a block diagram of a musical system in accordance with an exemplary embodiment of the invention.

The present invention, in some embodiments thereof, relates to a musical instrument and, more particularly, but not exclusively, to an organ-like device suitable for handicapped persons, for example for children.

In an exemplary embodiment of the invention, suitability for handicapped persons is provided by using large keys, instead of the small keys typically used for electric organs. For example, a key may be 3, 4, 5, 6, 7, 10, 12, 15 or more cm wide and/or such distance may be provided between centers of adjacent keys. Optionally, the keys are spaced apart, for example, by 5, 10, 20 or more or intermediate millimeters. In some embodiments of the invention, suitability for handicapped use is provided by the keys having a mechanical and/or electrical response that is adjusted, optionally personalized to the amount of and/or ability to control force applied by the user. Optionally, the keys include a manually, mechanically and/or electrically adjusted tensile resistance element, such as a spring that can be pretensioned by hand or using a built-in motor. Optionally or alternatively, the keys are adjusted with respect to mechanical and/or electrical damping, for anti-bouncing.

In an exemplary embodiment of the invention, the keys are made large enough for hitting with a fist, for example, 20% or 40% wider than the width of a hand of the target user. Optionally or alternatively, the key is made soft and/or covered with a soft coating, for example, rubber, to reduce injury.

Optionally or alternatively, suitability for handicapped use is provided by mounting the organ on an electrically powered stand which can raise and/or lower to match a user's height, for example, a height in a wheel chair. Optionally, the control of height is via a control on an upper face of the organ. Optionally or alternatively, the control of height is by a smart card reader or other wireless link which identifies the user to the organ, for example, a smart card mounted on a wheelchair may be read by a reader on the organ and/or stand. Optionally, the organ is placed on the stand. Optionally, other devices may be used with such a stand.

In an exemplary embodiment of the invention, such an organ is provided by retrofitting an existing organ, for example, by mounting a shell with large buttons thereon. Optionally, the large buttons mechanically and/or electrically engage keys of a standard type organ.

In an exemplary embodiment of the invention, the keys of the organ are coded in a manner which facilitates handicapped use, for example, being color coded, number coded, texture coded and/or marked in Braille. Optionally, matching sheet music is provided. Optionally, the use of a plurality of 2, 3, or more coding methods enhances use by the impaired.

In an exemplary embodiment of the invention, software is provided for converting sheet music to a color and number coded output. Optionally, the organ is connected to a computer and the display of musical instructions is on a screen of the computer. Optionally or alternatively, each key of the organ has associated therewith a lamp (e.g., LED) which can be lit up when the key is to be pressed. Optionally, the duration of illumination reflects a duration of desired key pressing.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Referring now to the drawings, FIG. 1 is a block diagram of a musical system 100 in accordance with an exemplary embodiment of the invention.

In an exemplary embodiment of the invention, system 100 includes a musical instrument 100, for example, an organ, an optional stand 102, optionally electrically adjusting. Optionally or alternatively, instrument 100 is attached to a computer system 106.

In some typical usage scenarios, a user is supported by a wheelchair system 132.

Referring specifically to instrument 100, instrument 100, optionally an organ includes a plurality of keys 110. Optionally, the keys are wide enough to be used by handicapped children and/or adults, for example, at least 3, 8, 10 cm wide or more (or such distances center to center). Optionally, a key is 22 cm long. Optionally, the key has a travel distance of, for example 0.5, 1, 2, 3, 4, 5, 6, 7 cm or more. Optionally, the keys are modularly attached so they can be changed for different users. Optionally, the keys can be connected to customized touch pads and/or various switches (e.g., seep and puff, plate, pillow) and/or voice operated keys, or other input devices used for handicapped users. Optionally, the organ is provided with one or more inputs (wired or wireless) for receiving an electrical or data connection form such an input device In an exemplary embodiment of the invention, the keys are color coded and optionally marked with numbers. In an exemplary embodiment of the invention, eight keys, for one octave are provided. Optionally, the colors are selected for example as follows, using an order used by musical therapists:

1—Do—turquoise
2—Re—yellow
3—Me—red
4—Fa—green
5—So—purple
6—La—orange
7—Si—pink
8—Do—blue In an exemplary embodiment of the invention, the organ indicates to a user a series of keys to press. Optionally, the keys are shown as a single sequence. Alternatively, each time a user presses a few keys, a new sequence is shown. Optionally, the indication comprises one or more of sounds, colors, lights on or near the keys, vibration of the keys (e.g., using electric vibrators mechanically coupled to the keys). Optionally, the user or another operator (e.g., a helper) can preprogram the sequence, or it can be provided by portable storage or network.

A power switch 114 is optionally provided. Optionally, an automatic power-off circuit is provided.

Optionally, one or more controls 112 is provided, for example, for initiating a record mode, a play back mode, a chord mode, and/or for activating connections, for example a connection to external speakers, a connection to an amplifier system and/or a connection to headphones. Separate connectors (not shown) may be provided, for example, a headphone socket.

In an exemplary embodiment of the invention, a rack, for example of transparent plastic, is provided to hold notes. In an exemplary embodiment of the invention, the notes are in the form of color bars with numbers inside, with the colors and numbers matching keys to press. Optionally, regular musical notation is provided as well, for example, as an overlay. Optionally or alternatively, words of a song are printed in alignment with the color bars (or other color marks). Optionally, the organ includes a device for turning pages of music sheets, or a changing display of such sheets. Optionally, the turning is automatically carried out by such device identifying the notes being played (e.g., using audio processing methods), by a user pressing a "please turn now" button, based on a time since a last key being pressed and/or based on a count of the keys pressed by a user.

Optionally, one or more speakers 118 or a connection to an audio system, are provided.

Optionally, not shown, a connector to a memory card (e.g., USB memory stick or flash memory card) is provided, for example, for loading songs and music into the organ and/or for downloading recordings. Optionally or alternatively, a network connection (not shown) is used for uploading and/or downloading.

Optionally, one or more indicators 119 for user feedback are provided. For example, such indicators may be used to indicate instructions to a user, such as which key to press and/or how long to press for, a beat, and/or a correctness of timing (as compared to an internal musical representation In an exemplary embodiment of the invention, an organ is constructed by taking an organ music card or an integrated circuit and attaching large buttons, etc. for example, as described herein. In other embodiments, an existing organ is disassembled, retrofit and/or otherwise used, for example, as described herein.

Referring specifically to stand 102, in an exemplary embodiment of the invention, a stand, optionally adjusting is provided to match the height of the keys to a user.

In an exemplary embodiment of the invention, the stand includes a telescoping stand unit 120 optionally powered by a motor 122. Optionally, a gear 124 is provided to interconnect motor 122 and stand unit 120.

In an exemplary embodiment of the invention, a height controller 126 is provided to control the motor, optionally using a position sensor. Optionally, the controller provides one of several fixed heights, for example, suitable for child, adult, standing and/or sitting. Optionally or alternatively, the controller provides the functions of "up", "down" and optionally "stop".

In an exemplary embodiment of the invention, the control is positioned for use by the user (e.g., near the organ keys. Alternatively, the control is activated by a helper and may be located on a side away form the user and/or inadvertent activation.

In an exemplary embodiment of the invention, a user switch 128 is provided for selecting a desired stand position and/or stand movement Referring specifically to wheelchair system 104, in an exemplary embodiment of the invention, the system includes a wheelchair 132, for example of any type known in the art. Optionally, instrument 100 is mounted on or otherwise mechanically coupled to the wheelchair.

In an alternative embodiment of the invention, the height adjusting is sued so that a person is correctly situated relative to instrument 100. Optionally, an RFID source 134 or smart card, is provided for and read by reader 130.

Referring specifically to computer system 106, in an exemplary embodiment of the invention, a computer 140 is connected to instrument 100, for example, using an RS232 connection or a USB connection. Optionally, the computer is mounted on stand 102.

In an exemplary embodiment of the invention, a user interface 146 is provided, for example, a keyboard-mouse based graphical user interface. Optionally, a display 148 is provided. Optionally, display 148 is used for showing musical notes and/or other instructions and/or feedback. Optionally a music playback device, such as a CD player or a connector to a USB MP3 player or a flash memory card reader or other media, is provided as part of the system and/or coupled thereto.

Optionally, a translation software 144 is provided on computer 140, for example, for converting standard musical notations into color-number notations as described herein. Optionally, a printing program is provided. Optionally or alternatively, computer 140 acts as the organ or has an organ card installed therein. Optionally or alternatively, the computer display s used for showing notes and/or providing feedback.

In an exemplary embodiment of the invention, power is shared among the various components, for example, power for stand 102 coming from instrument 100 and/or computer system 106. Optionally, instrument 100 is battery powered, for example, by 6 AA size 1.5 Volt batteries. Optionally or alternatively, a rechargeable battery is provided.

Figure 2:
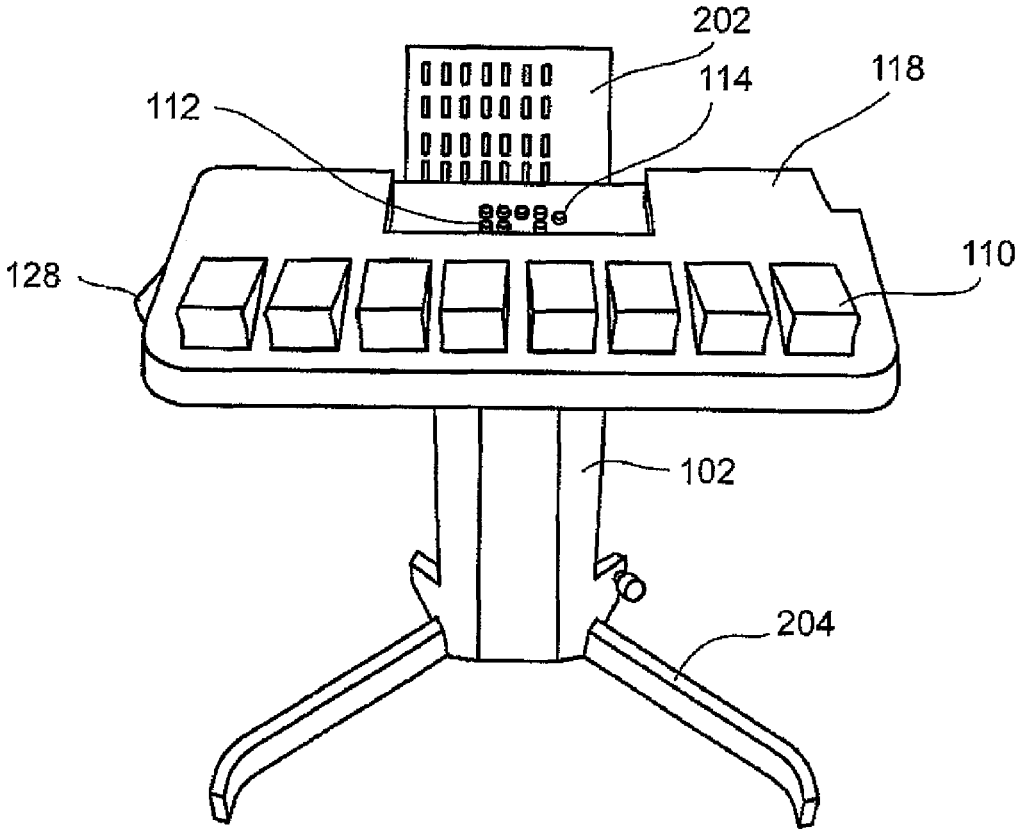
FIG. 2 is a schematic perspective view of a musical system in accordance with an exemplary embodiment of the invention.

FIG. 2 is a schematic perspective view of an exemplary implementation of musical system 100. Also shown are musical notes 202 on a printed paper supported by rack 116 (not visible).

Relating specifically to stand 102, as shown, stand 102 includes two feet supports 204 that splay towards a user position. In an exemplary embodiment of the invention, the number and/or size and/or shape of such feet are selected so that a wheelchair can approach the instrument without banging into stand 102. Optionally, keys 110 are cantilevered over feet 204, to form space for user legs and/or a wheelchair.

Figure 3:
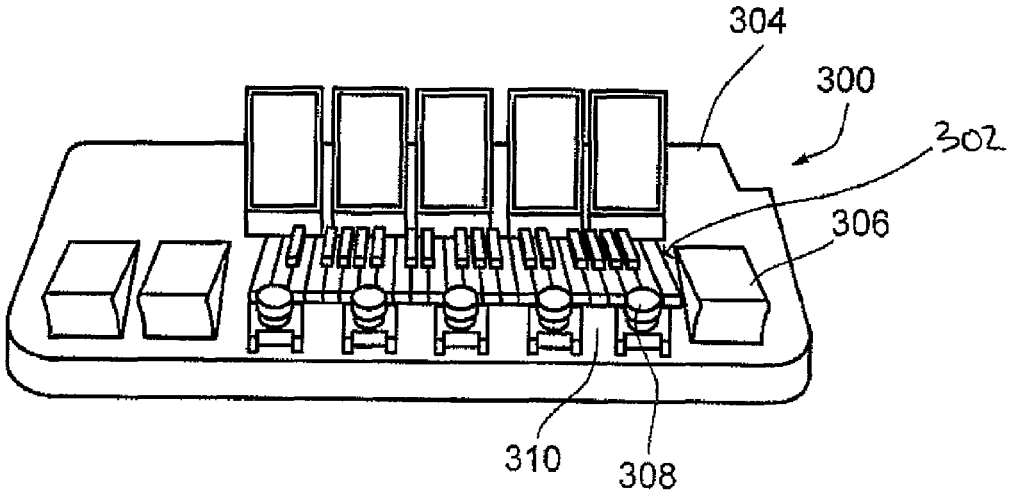
FIG. 3 is a schematic perspective view of a retrofit casing for an organ, in accordance with an exemplary embodiment of the invention.

FIG. 3 is a schematic perspective view of an organ system 300 including a retrofit casing for an organ, in accordance with an exemplary embodiment of the invention. In some cases, instrument 100 is created using an organ circuitry (e.g., audio circuitry 108) from an existing organ. Optionally, the organ circuitry is a PCB (printed circuit board) with electronic components that form an electric circuit which provides the same functions as a standard electrical musical organ.

In an alternative embodiment, a whole organ 302 is made handicapped accessible, by retrofitting with a casing 304. In an exemplary embodiment of the invention, casing 304 includes a plurality of keys 306, each of which is optionally aligned with a key of the organ and/or a switch 308. In case of a switch, wiring 310 optionally electrically connects such switches to the wiring of original keys of the organ.

In an alternative retrofit, each key 306 activates a plurality or original organ keys.

Figure 4:
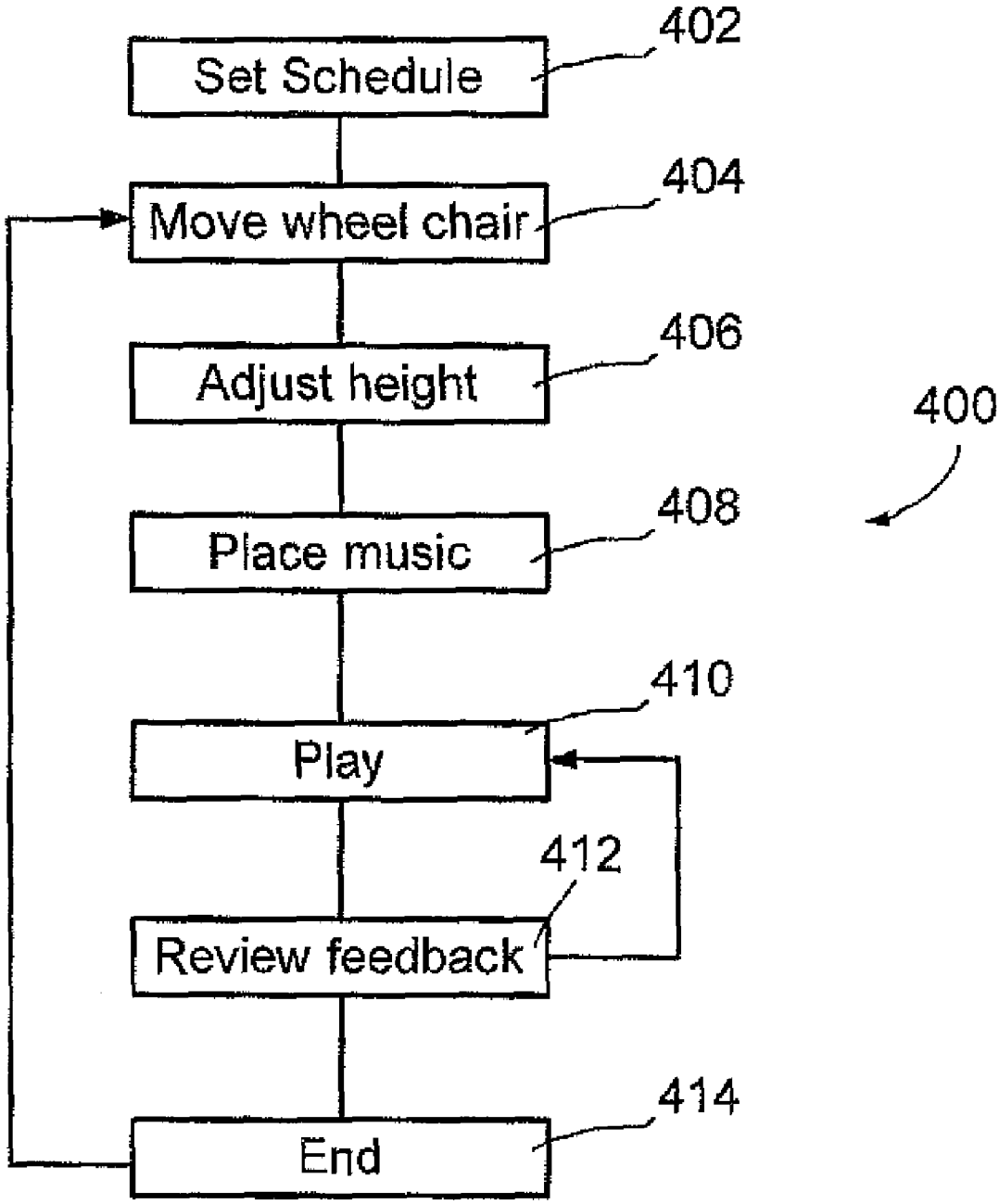
FIG. 4 is a flowchart of a method of using a musical instrument, in accordance with an exemplary embodiment of the invention.

FIG. 4 is a flowchart 400 of a method of using a musical instrument, in accordance with an exemplary embodiment of the invention.

At 402, a schedule for using the instrument is set. Optionally, one or more sheets of music is selected. Optionally, a computer is appropriately programmed.

At 404, a wheelchair is moved to adjacent instrument 100. Alternatively, a user walks over to the instrument.

At 406, the height of instrument 100 is adjusted, for example, manually or automatically.

At 408, music is placed on rack 116, for example, a coded music booklet or an electronic display music sheet is placed on rack 116 by a caregiver or an accompanier who turns the pages upon the need.

At 410, the user plays the music. Optionally, feedback is provided to the user, for example, providing visual and/or acoustic feedback, or providing feedback (e.g., a signal if the correct key was pressed or not) via a device attached to the organ, such as a tactile feedback coupled to the user and controlled by the organ.

At 412, the user is optionally provided with feedback, for example, by a teacher or parent. Playing (410) is optionally repeated, optionally with different music and/or parameters.

At 414, the playing is ended and a different user optionally approaches instrument 100.

In an exemplary embodiment of the invention, playing is used for practicing one or more of control of posture and balance (e.g., while sitting or standing or lying down), maintaining a correct relative position between the user and the instrument, smooth flowing motions, optionally with stamina and/or maintaining beat, control of speed, range and/or force while moving hand from place to place and/or bi-lateral coordination.

Optionally, playing is used for maintaining and/or enhancing cognitive ability in neurodegenerative conditions, such as Alzheimer's disease and Dementia.

In an exemplary embodiment of the invention, playing instrument 100 facilitates one or more of maintaining attention, coordinating inputs and actions and/or starting and/or completing series.

In an exemplary embodiment of the invention, playing instrument 100 improves one or more of the following mental abilities: memory, attention, visual perception, sorting, language (e.g., by user exhibiting understanding following of instructions and/or naming of numbers, colors and/or songs), generalization and/or motion planning.

In an exemplary embodiment of the invention, playing instrument 100 improves one or more of the following physical abilities: joint motions, joint stability, muscle strength, muscle tension and/or muscle stamina.

As used herein the term "about" refers to ±10%.

The terms "comprises", "comprising", "includes", "including", "having" and their conjugates mean "including but not limited to". This term encompasses the terms "consisting of" and "consisting essentially of".

The phrase "consisting essentially of" means that the composition or method may include additional ingredients and/or steps, but only if the additional ingredients and/or steps do not materially alter the basic and novel characteristics of the claimed composition or method.

As used herein, the singular form "a", "an" and "the" include plural references unless the context clearly dictates otherwise. For example, the term "a compound" or "at least one compound" may include a plurality of compounds, including mixtures thereof.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A musical instrument adapted for the use of handicapped persons, comprising:

(a) a keyboard comprising a plurality of keys and at least one audio signal generating circuitry which generates a music-quality audio signal in response to key pressing;

(b) an electrically controlled stand on which said keyboard is mounted, suitable for raising said keyboard to at least a height of 40 cm;

(c) at least one user input which controls a height of said stand;

(d) a casing sized to fit over said keyboard, wherein said casing comprises a housing and at least 8 keys arranged in a row mounted on the housing, each key being at least 3 cm wide and adapted for being used by hitting with a fist and each of said keys of the casing adapted to activate at least one of said plurality of keys of said keyboard;

wherein each of said keys of the casing electrically engage at least one of said plurality of keys of said keyboard.

2. An instrument according to claim 1, wherein said input is mounted on said keyboard.

3. An instrument according to claim 1, wherein said input comprises a smart card reader.

4. An instrument according to claim 1, wherein each of said keys of the casing is color- and number-coded in a human-visual manner and in a tactile manner.

5. An instrument according to claim 1, including a connection to a computer.

6. An instrument according to claim 1, including a display which shows keys being played or to be played.

7. An instrument according to claim 1, wherein said instrument comprises an electric organ:

wherein said at least one audio signal generating circuitry comprises an audio circuitry configured to convert key-presses on said keys into musical notes of a musical quality over a range of one octave or more.

8. An instrument according to claim 7, wherein said keys of said casing are at least 40 cm wide in total.

9. An instrument according to claim 1, wherein said keys of the casing are each wider than 3 cm.

10. A music system, comprising:

(a) an instrument according to claim 1, wherein said stand is at a first height; and (b) a wheelchair having a lap height matching said first height.

* * * * *